United States Patent [19]

Sprague

[11] 4,208,554

[45] Jun. 17, 1980

[54] IGNITION DISTRIBUTOR ROTOR HAVING A SILICONE VARNISH COATED OUTPUT SEGMENT FOR SUPPRESSING NOISE AND A METHOD OF MANUFACTURE THEREFOR

[75] Inventor: Richard L. Sprague, Anderson, Ind.

[73] Assignee: General Motors Corporation, Detroit, Mich.

[21] Appl. No.: 963,089

[22] Filed: Nov. 22, 1978

[51] Int. Cl.[2] ..... H01H 19/00; F02P 7/02; H01H 11/00

[52] U.S. Cl. ..... 200/19 DR; 29/622; 29/825; 123/146.5 A; 200/238

[58] Field of Search ..... 200/19 DR, 19 DC, 19 R, 200/237, 19, 238; 123/146.5 A, 148 R, 148 P; 219/91.21, 91.2; 174/110 S, 94 R; 156/275; 29/622, 628, DIG. 13, DIG. 24

[56] References Cited

U.S. PATENT DOCUMENTS

| | | | |
|---|---|---|---|
| 2,227,972 | 1/1941 | Hood et al. | 200/19 |
| 3,277,268 | 10/1966 | Williams et al. | 219/91.21 X |
| 3,418,444 | 12/1968 | Ruehlemann | 219/91.21 X |
| 3,887,780 | 6/1975 | Crim | 200/19 DR |
| 3,941,107 | 3/1976 | Rockwell | 200/19 DR X |
| 4,007,342 | 2/1977 | Makino et al. | 200/19 R |
| 4,031,284 | 6/1977 | Ingraham | 174/6 X |
| 4,039,787 | 8/1977 | Hori et al. | 200/19 R |
| 4,074,090 | 2/1978 | Hayashi et al. | 200/19 DR |
| 4,082,926 | 4/1978 | Marks et al. | 200/19 DR |

OTHER PUBLICATIONS

Kofoid, M. J.; "Phenomena at the Metal-Dielectric Junctions of High-Voltage Insulators in Vacuum and Magnetic Field"; AIEE Transactions, Dec. 1960; vol. 79(3), pp. 991-999.

Kofoid, M. J.; "Effect of Metal-Dielectric Junction Phenomena On High-Voltage Breakdown Over Insulators in Vacuum"; AIEE Transactions, Dec. 1960; vol. 79(3), pp. 999-1004.

*Primary Examiner*—James R. Scott

*Attorney, Agent, or Firm*—Richard G. Stahr

[57] ABSTRACT

The output segment of an ignition distributor rotor having an output segment and a spring contact member in series is coated with a silicone varnish dielectric material for effecting the suppression of radio frequency interference radiation and, to establish an electrical connection between the ignition distributor rotor spring contact member and the silicone varnish coated rotor output segment, a potential is applied across the spring contact member, the rotor output segment and an air gap in series and of a sufficient level to overstress the dielectric strength of the silicone varnish material to thereby effect a rupture of the silicone varnish material to establish an electrical connection through electrical arcing between the spring contact member and the rotor output segment.

4 Claims, 6 Drawing Figures

IGNITION DISTRIBUTOR ROTOR HAVING A SILICONE VARNISH COATED OUTPUT SEGMENT FOR SUPPRESSING NOISE AND A METHOD OF MANUFACTURE THEREFOR

This invention is directed to a radio frequency interference radiation suppressing ignition distributor rotor and, more particularly, to an ignition distributor rotor of this type having an output segment coated with a silicone varnish material for effecting the suppression of radio frequency interference radiation and a method for establishing an electrical connection between the silicone varnish coated output segment and another rotor member to which it must be electrically connected.

BACKGROUND OF THE INVENTION

Various studies have shown that one of the sources of motor vehicle radio frequency interference radiation is the breakdown of the arc gap between the distributor rotor output segment tip surface and each of the circumferentially disposed distributor output terminals. Laboratory observations indicate that the radio frequency interference generated across this arc gap is substantially reduced with a reduction of breakdown potential level. These laboratory observations further indicate that excessive radio frequency interference radiation is produced when the breakdown potential of this arc gap exceeds a level of the order of twelve kilovolts. It has been found that the breakdown potential level required to break down this arc gap is substantially reduced by the application of a silicone varnish material to the rotor output segment in the vicinity of the output tip surface thereof that extends substantially parallel to the axis of rotation of the rotor body member and which, while the rotor segment is rotated with the body member, traces a circular path radially inwardly from the circumferentially disposed distributor output terminals by a predetermined arc gap. It has also been found that a simple and efficient method for applying the silicone varnish material to the rotor output segment is to completely immerse the segment in a bath of the silicone varnish material whereby the segment is completely coated. As the silicone varnish material is an electrical insulator, a method for quickly and easily establishing an electrical connection between the silicone varnish coated ignition distributor rotor output segment and another ignition distributor member to which it must be electrically connected is desirable.

It is, therefore, an object of this invention to provide an improved radio frequency interference radiation suppressing ignition distributor rotor having a silicone varnish coated distributor rotor output segment.

It is another object of this invention to provide a method for establishing an electrical connection between a silicone varnish coated ignition distributor rotor output segment and another ignition distributor member to which it must be electrically connected.

It is another object of this invention to provide a method for establishing an electrical connection between a silicone varnish coated ignition distributor rotor output segment and another ignition distributor member to which it must be electrically connected in overlap engagement by electrically rupturing the silicone varnish material located between the respective surface overlap areas of the silicone varnish coated rotor output segment and the other member.

It is another object of this invention to provide a method for manufacturing an ignition distributor rotor that suppresses radio frequency interference radiation.

SUMMARY OF THE INVENTION

In accordance with this invention, a radio frequency interference radiation suppressing ignition distributor rotor is provided wherein the rotor output segment that is coated with a silicone varnish material to effect the suppression of radio frequency interference radiation and another rotor member to which is must be electrically connected are assembled to a rotor body in such a manner as to have adjacent surface overlap areas in clamped engagement and the silicone varnish material between the respective surface overlap areas is electrically stressed by a potential level of a sufficient magnitude to rupture the silicone varnish material to thereby establish an electrical connection between the output segment and the other member.

BRIEF DESCRIPTION OF THE DRAWING

For a better understanding of the present invention, together with additional objects, advantages and features thereof, reference is made to the following description and accompanying drawing in which.

In the several figures of the drawing, like elements have been assigned like numerals of reference.

DESCRIPTION OF THE PREFERRED EMBODIMENT

Figure 1:
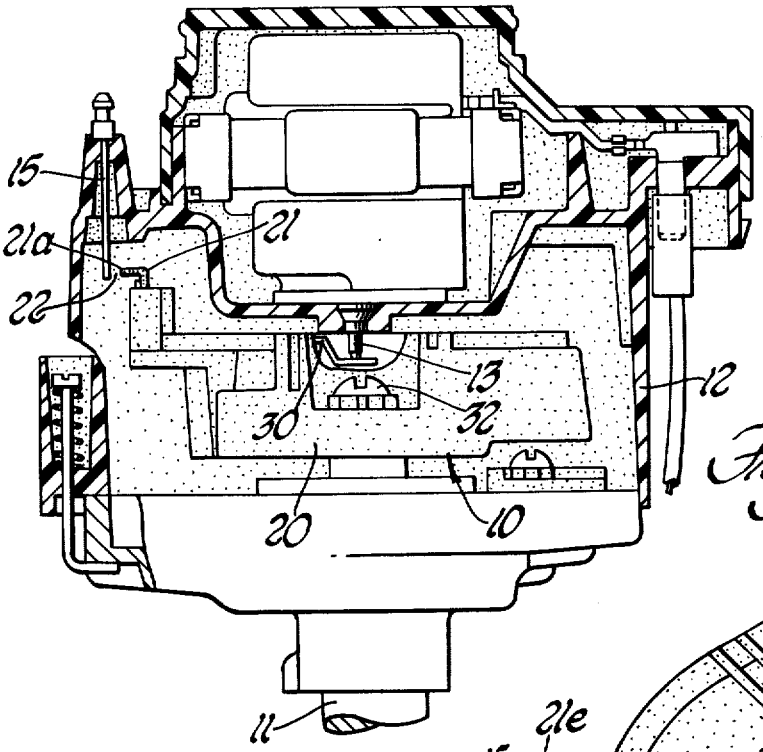
FIG. 1 is a vertical section view of a portion of an ignition distributor showing an ignition distributor rotor manufactured by the method of this invention mounted therein.

As is well known in the automotive art, the ignition distributor rotor 10, FIG. 1, is rotated by a driving shaft 11, usually gear coupled to the cam shaft of the associated internal combustion engine, within a distributor cap 12 having a center input terminal 13, to which is connected one end of the associated ignition coil secondary winding, and a plurality of output terminals, one of which is shown at 15, circumferentially disposed about the rotor 10 axis of rotation to which the engine spark plugs are connected through respective spark plug leads.

Although only one distributor output terminal is shown in FIG. 1, in which the distributor cap 12 is illustrated in cross section, it is to be specifically understood that an output terminal is provided for each of the engine spark plugs and that they are circumferentially disposed about the center input terminal in a manner well known in the automotive art.

The ignition distributor rotor comprises a body member 20 of an electrical insulating material adapted to engage and be rotated about an axis of rotation by driving shaft 11 and a rotor output segment 21 of an electrically conductive material, such as copper, supported by body member 20. Rotor output segment 21 extends in a direction toward and terminates radially inwardly from the circumferentially disposed distributor output terminals. The cross section surface area of rotor output segment 21 at the extremity thereof nearest the circumferentially disposed distributor output terminals defines an output tip surface 21*a* that extends substantially parallel to the axis of rotation of body member 20 and which, while rotor segment 21 is rotated with body member 20, traces a circular path radially inwardly from the circumferentially disposed distributor output terminals by a predetermined arc gap 22. In the automotive art, the arc gap corresponding to arc gap 22 is usually called the "distributor gap" and, hereinafter, will be so referred to. Without intention or inference of a limitation thereto, rotor segment 21 is illustrated in the drawing as being of a rectangular cross-section having opposite top and bottom flat face surfaces 21*b* and 21*c*, FIG. 3, and opposite edge surfaces 21*d* and 21*e*, FIG. 4. With this embodiment, the top and bottom flat face surfaces 21*b* and 21*c* define, at the extremities thereof nearest the circumferentially disposed distributor output terminals, the top and bottom edge boundaries of output tip surface 21*a* that extends substantially parallel to the axis of rotation of body member 20.

Rotor output segment 21 may be placed in electrical circuit contact with center electrode 13 through an elongated spring contact member 30 of an electrically conductive material having spring characteristics such as stainless steel, for example. Spring contact member 30 and rotor output segment 21 are supported by rotor body member 20 and maintained in clamped engagement over respective surface overlap areas located beneath a retaining member 31. That is, the adjacent surface areas of both spring contact member 30 and rotor output segment 21 are in overlapped relationship and maintained in clamped engagement by retaining member 31. Spring contact member 30 is also arranged to be in electrical contact with center input terminal 13 of distributor cap 12. Body member 20 may be secured to the distributor centrifugal weight base, not shown, by screws, one of which is illustrated in FIG. 1 and referenced by the numeral 32. As the distributor centrifugal weight base is rotated by shaft 11 in a manner well known in the automotive art, body member 20 is rotated therewith about a vertical axis of rotation as viewing FIG. 1. One example of an ignition distributor with which the distributor rotor of this invention may be used is described in U.S. Pat. No. 3,923,028, Campbell et al, which issued Dec. 2, 1975 and is assigned to the same assignee as is this invention. It is to be specifically understood, however, that any other arrangement through which body member 20 is adapted to engage and be rotated by driving shaft 11 may be employed without departing from the spirit of the invention.

As has been previously brought out, the higher the potential level required to break down the distributor gap, the higher is the radio frequency interference radiation. Consequently, one way of reducing the distributor gap radio frequency interference radiation is to reduce the magnitude of the potential level required to break down the distributor gap. As it is necessary that free electrons be provided to initiate an arc across the distributor gap and since the number of free electrons provided is determined by the available charge or the electric field intensity, one way of reducing the distributor gap breakdown potential is to provide a higher electric field intensity in the vicinity of the distributor gap. In this regard, actual observations show that the distributor gap breakdown potential is inversely proportional to the electric field intensity; the greater the electrical field intensity, the lower the breakdown potential. It has been found that the electric field intensity at the distributor gap may be increased by the presence of a dielectric material upon the rotor output segment in the vicinity of or in close proximity to the distributor gap 22. In an actual embodiment, the dielectric material employed is a commercially available silicone varnish material marketed by the General Electric Company or the Dow Corning Chemical Company under the respective designations SR 6777 and No. 991. This localized intensified electric field enhances electron discharge from the metal of the rotor output segment 21 for the reason that this intensified electric field produces a local corona discharge. The radiation resulting from this local corona discharge causes electrons to be emitted into the distributor gap 22. Upon the initiation of the emission of electrons into the distributor gap, the effect avalanches, a condition which results in a significantly reduced distributor gap 22 breakdown potential. It may be noted that, since the emission of electrons from the metal of the rotor output segment 21 is required to initiate the distributor gap 22 discharge, rotor output segment 21 should be negatively polarized. In the actual embodiment, the breakdown potential across a three-millimeter distributor gap is reduced from 20 kilovolts to 8 kilovolts.

Figure 2:
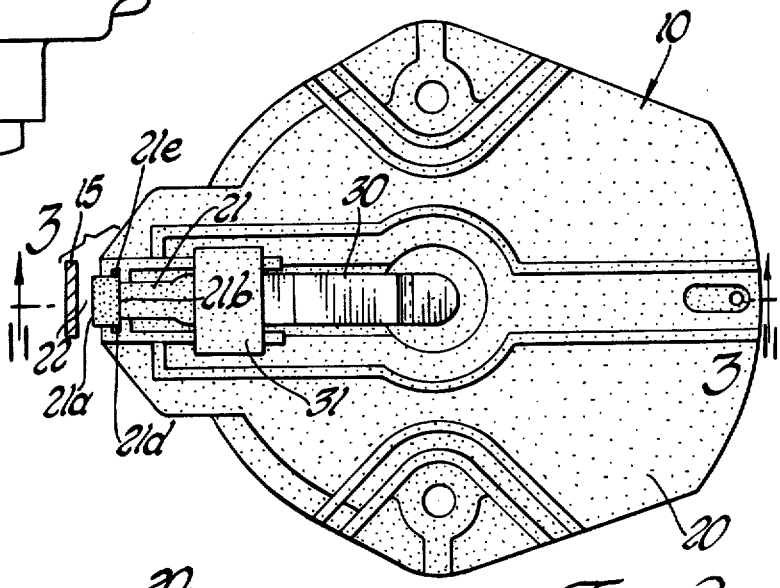
FIG. 2 is a top view of the distributor rotor of FIG. 1 showing the relationship between the rotor output segment output tip surface and one of the distributor output terminals.
Figure 3:
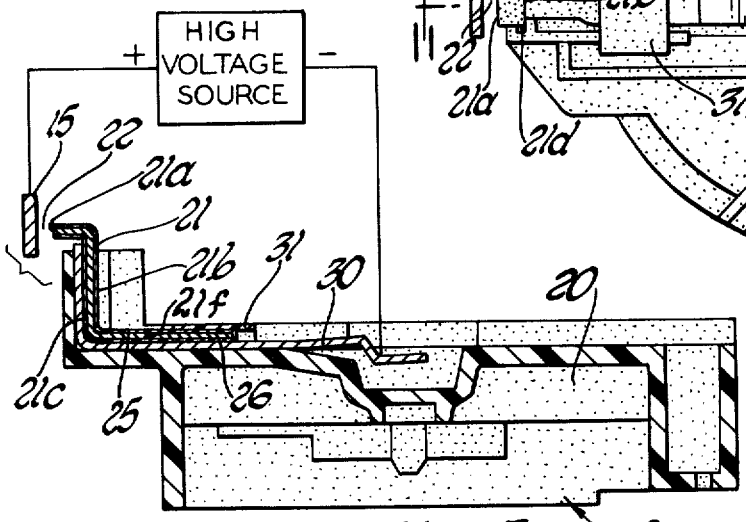
FIG. 3 is a section view of FIG. 2 taken along line 3—3 and looking in the direction of the arrows.
Figure 4:
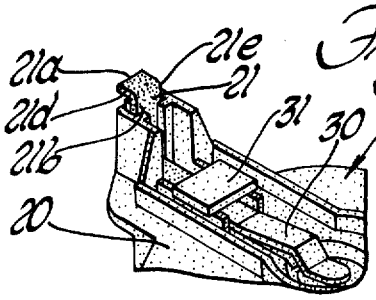
FIG. 4 is a perspective view of a portion of the distributor rotor of FIG. 1.
Figure 5:
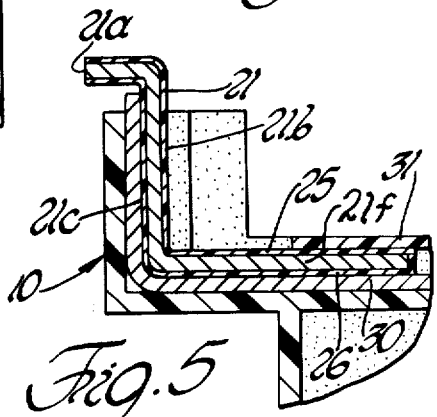
FIG. 5 is an enlarged view of a portion of FIG. 3 showing a silicone varnish coated ignition distributor rotor output segment and another ignition distributor member having adjacent surface overlap areas in clamped engagement with a layer of dielectric material therebetween.

As has been previously brought out, it has been found that a simple and efficient method for applying the silicone varnish material 25, FIG. 5, to that portion of the rotor output segment 21 in the vicinity of or in close proximity to the distributor gap 22 is to immerse the entire rotor output segment 21 in a bath of the silicone varnish material and cure it. However, as the silicone varnish material is a dielectric or an electrical insulator, the entire surface area of the rotor output segment is covered by an electrical insulating layer as a result of this immersing operation as shown in FIG. 5. FIGS. 1 through 4 are of such a scale that the illustration of the thin coating of silicone varnish material 25 on rotor output segment 21 is not practical. It is to be understood, however, that the entire surface area of the rotor output segment 21 of each of these Figures is coated with silicone varnish material 25. With the arrangement as shown in the drawing, the ignition spark potential produced by the secondary winding of the associated ignition coil may be delivered to successive ones of the circumferentially disposed distributor output terminals as rotor body member 20 is rotated by shaft 11 in timed relationship with an associated internal combustion engine through a circuit that may be traced through input terminal 13, spring contact member 30, rotor output segment 21 and the distributor gap 22 between the rotor output segment output tip face surface 21*a* and each of the distributor output terminals. The distributor gap 22 is best seen in FIGS. 1, 2 and 3 of the drawing. So that the circuit just described is electrically complete, it is necessary that electrical connection be established between spring contact member 30 and the silicone varnish coated rotor output segment 21.

Actual observations also indicate that it is extremely important that the silicone varnish dielectric material not be present upon any portion of the rotor output segment 21 output tip surface area 21*a* and, further, not be present within distributor gap 22 as both of these conditions result in intolerable "in car" FM radio receiver noise or interference. As a consequence, subsequent to the immersing operation, the silicone varnish material is removed from the rotor output segment 21 output tip surface area 21*a*.

In the actual manufacture of an ignition distributor rotor in accordance with this invention, an electrical insulating material is formed into a rotor body member of a selected shape; an electrically conductive material of the type having spring characteristics is formed into an elongated spring contact member; an electrically conductive material is formed into a rotor output segment of a selected shape and having an output tip face portion; the entire surface area of the rotor output segment is coated with a silicone varnish dielectric material by complete immersion of the rotor output segment in a bath of the silicone varnish material; the silicone varnish material coating on the rotor output segment is cured; the cured silicone varnish material coating is removed from the output tip face portion of the rotor output segment; the silicone varnish material coated rotor output segment and spring contact member are mounted upon and supported by the body member in such a manner that a surface area portion of the rotor output segment and the spring contact member are overlapped and maintained in clamped engagement over respective surface overlap areas with the longitudinal axis of each extending in the same direction toward an edge boundary of the body member and the output tip face portion of the rotor output segment extends substantially parallel to the axis of rotation of the body member beyond an edge boundary of the body member; and an electrical potential is applied across the silicone varnish material layer 26 that is between the surface overlap areas of the rotor output segment and the spring contact member of a sufficient level to overstress the dielectric strength of a silicone varnish material for effecting a rupture of the silicone varnish material layer 26 between these surface overlap areas whereby an electrical connection is established between the surface overlap areas of the rotor output segment and spring contact members.

Specifically with regard to the embodiment illustrated in the drawing, during manufacture, spring contact member 30 and silicone varnish coated rotor output segment 21 are assembled onto the rotor body 20 and are maintained in clamped engagement over respective surface overlap areas by retaining member 31. One way to apply an electrical potential across the silicone varnish material layer 26 that is between these respective surface overlap areas is, after assembly, to apply across spring contact member 30, rotor output segment 21 and distributor gap 22 in series an electrical potential of a sufficient level to overstress the dielectric strength of the silicone varnish material layer 26 that is located between the surface overlap areas of rotor output segment 21 and spring contact member 30. This applied electrical potential effects the rupture of the silicone varnish material layer 26 between these surface overlap areas to thereby establish an electrical connection between the surface overlap areas of the rotor output segment 21 and spring contact member 30. In the actual embodiment, the assembled ignition distributor is mounted in a test fixture with the ignition coil primary winding connected across the output terminals of an electronic ignition system of the type disclosed and disclosed in U.S. Pat. No. 3,838,672, Richards et al, that issued Oct. 1, 1974 and is assigned to the same assignee as is this invention. With operating potential applied to the ignition system, the ignition distributor rotor 10 is rotated in the same manner as it would be rotated when mounted upon as associated internal combustion engine and in such a manner that the electronic ignition system is operative. Consequently, when the electronic ignition system operates to interrupt the ignition coil primary winding energizing circuit to induce an ignition spark creating potential in the secondary winding thereof, this ignition spark creating potential is the potential applied across the spring contact member 30, rotor output segment 21 and air gap 22 in series. It is to be specifically understood, however, that any high voltage potential source may be employed as this potential without departing from the spirit of the invention.

With regard to the silicone varnish material coating and curing operations, it may be desirable to air dry the coating or layer of silicone varnish material on the rotor output segment after the removal thereof from an initial immersion in the silicone varnish bath for a period of time of the order of ten minutes to remove the volatile solvents and thereby prevent blistering of the silicone varnish layer, to then bake the silicone varnish coated and air dried rotor output segment for a period of time of the order of one minute at an elevated temperature of the order of 400° F., to again immerse the baked output rotor segment in the silicone varnish material bath, to air dry the coating or layer of silicone varnish material on the rotor output segment after the removal thereof from the second immersion in the silicone varnish material bath for a period of time of the order of ten minutes for the same reason as hereinabove set forth and to rebake the twice immersed and air dried rotor output segment for a period of time of the order of one hour at an elevated temperature of the order of 400° F. In the actual embodiment, a silicone varnish material coating of a thickness of 0.001" to 0.003" is obtained. Depending upon the nature of the materials used, all of these detailed steps may not be necessary.

For the reasons that it is extremely important that the silicone varnish dielectric material not be present upon any portion of the rotor output segment 21 output tip surface area 21*a* and, further, not be present within distributor gap 22, it is preferable that the silicone varnish dielectric material employed be of the thermoset type. That is, of a type that, subsequent to being cured, does not soften or melt in the presence of heat. For these same reasons, the silicone varnish dielectric material is removed from the entire output tip surface area 21*a* only. The result is a rotor output segment having a coating of preferably a thermoset silicone varnish dielectric material bonded to substantially the entire surface area thereof except the output tip surface area whereby there is provided an interface between the silicone varnish dielectric material and the rotor segment material that is located in close proximity to the rotor output tip surface area. As has been previously brought out, it has been found that the electric field intensity at the distributor gap may be increased by the presence of a dielectric material upon the rotor output segment in the vicinity of or in close proximity to the distributor gap. As the interface between the silicone varnish dielectric material and the rotor segment material is also in close proximity to the distributor gap, the silicone varnish dielectric material coating is effective to reduce the breakdown potential across the distributor gap whereby the radiation of radio frequency interference generated by an electrical discharge across the distributor gap is suppressed.

Figure 6:
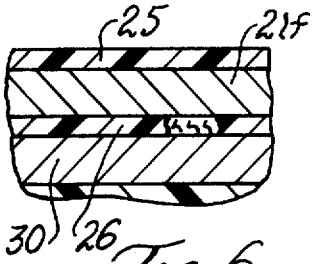
FIG. 6 is an exaggerated localized view of the contact spring member and rotor output segment having at least one ruptured dielectric opening.

The electrical potential that is applied across the silicone varnish dielectric material layer 26 located between the surface overlap areas of the rotor output segment 21 and spring contact member 30 of a sufficient level to overstress the dielectric strength of the silicone varnish dielectric material is effective to rupture the silicone varnish dielectric material layer between these surface overlap areas. As a result, at least one opening is formed through a portion of the rotor output segment silicone varnish dielectric material coating that is in engagement with the spring contact member 30 for providing a conductive path between the rotor output segment and spring contact member that is effected by electrical arcing through the opening. There may be a plurality of openings formed through the silicone varnish dielectric material coating upon being stressed by the electrical potential applied thereacross, however, at least one opening is effective to establish an electrical connection between the rotor output segment and spring contact member. In FIGS. 5 and 6, that portion of the surface area of rotor output segment 21 that overlaps a corresponding surface area of spring contact member 30 is referenced by the numeral 21*f* and in FIG. 6, an exaggerated localized view of a portion of contact spring member 30 and rotor output segment 21 showing one ruptured dielectric opening is set forth. The silicone varnish dielectric material employed in the actual embodiment has a dielectric constant of the order of 3.1 and a dielectric strength of 1000 to 1600 volts per mil of thickness. The voltage level required to rupture the silicone varnish dielectric material layer 26 between the surface overlap areas of rotor output segment 21 and spring contact member 30, therefore, is equal to the product of the dielectric strength of the dielectric material employed multiplied by the thickness of the layer in mils. In the actual embodiment, this voltage level is within a range of 1000 to 4800 volts depending upon the thickness of the silicone varnish coating, 0.001" to 0.003", and the dielectric strength of the material employed, 1000 to 1600 volts per mil of thickness.

While a preferred embodiment of the present invention has been shown and described, it will be obvious to those skilled in the art that various modifications and substitutions may be made without departing from the spirit of the invention, which is to be limited only within the scope of the appended claims.

The embodiments of the invention in which an exclusive property or privilege is claimed are defined as follows:

1. A method for establishing an electrical connection between an ignition distributor rotor output segment and a spring contact member wherein the output segment is coated with a silicone varnish material for effecting the suppression of radio frequency interference radiation and wherein the rotor output segment and the spring contact member are supported by a rotor body member of an insulating material and maintained in clamped engagement over respective surface overlap areas comprising the step of applying a potential across the said silicone varnish material layer that is between said surface overlap areas of said rotor output segment and said spring contact member of a sufficient level to overstress the dielectric strength of said silicone varnish material for effecting a rupture of said silicone varnish material layer between said surface overlap areas whereby an electrical arcing connection is established between the surface overlap areas of said rotor output segment and said spring contact member.

2. A method for establishing an electrical connection between an ignition distributor rotor output segment and a spring contact member wherein the output segment is coated with a silicone varnish material for effecting the suppression of radio frequency interference radiation and wherein the rotor output segment and the spring contact member are supported by a rotor body member of an insulating material and maintained in clamped engagement over respective surface overlap areas comprising the step of applying a potential across said spring contact member, said rotor output segment and an air gap in series and of a sufficient level to overstress the dielectric strength of the said silicone varnish material layer that is between said surface overlap areas for effecting a rupture of said silicone varnish material layer between said surface overlap areas whereby an electrical arcing connection is established between the surface overlap areas of said rotor output segment and said spring contact member.

3. A radio frequency interference suppressing ignition distributor rotor of the type adapted to be rotated about its axis within a distributor cap having a plurality of output terminals circumferentially disposed about the rotor axis of rotation comprising:

a body member of an electrical insulating material rotatable about an axis of rotation;

an elongated spring contact member of an electrically conductive material;

a rotor segment of an electrically conductive material having an output tip surface;

means for mounting said spring contact member and said rotor segment upon said body member in such a manner that said spring contact member and said rotor segment are maintained in clamped engagement over respective surface overlap areas with said rotor segment being so positioned that said output tip surfaces thereof extends substantially parallel to said axis of rotation of said body member and, while said rotor segment is rotated with said body member, traces a circular path radially inwardly from said circumferentially disposed distributor cap output terminals by a predetermined distributor arc gap;

a coating of a thermoset silicone varnish material bonded to substantially the entire surface area of said rotor segment except said output tip surface whereby there is provided an interface between said silicone varnish material and the rotor segment material that is located in close proximity to said output tip surface, said coating being effective to reduce the breakdown potential across said distributor arc gap whereby the radiation of the radio frequency interference generated by an electrical discharge across said distributor arc gap is suppressed; and at least one opening in a portion of said silicone varnish material coating that is in engagement with said spring contact member for providing an electrical arcing conductive path between said rotor segment and spring contact member.

4. A radio frequency interference suppressing ignition distributor rotor of the type adapted to be rotated about its axis within a distributor cap having a plurality of output terminals circumferentially disposed about the rotor axis of rotation comprising:

a body member of an electrical insulating material rotatable about an axis of rotation;

an elongated spring contact member of an electrically conductive material;

a rotor segment of an electrically conductive material having an output tip surface;

means for mounting said spring contact member and said rotor segment upon said body member in such a manner that said spring contact member and said rotor segment are maintained in clamped engagement over respective surface overlap areas with said rotor segment being so positioned that said output tip surfaces thereof extends substantially parallel to said axis of rotation of said body member and, while said rotor segment is rotated with said body member, traces a circular path radially inwardly from said circumferentially disposed distributor cap output terminals by a predetermined distributor arc gap;

a coating of a thermoset silicone varnish material bonded to substantially the entire surface area of said rotor segment except said output tip surface whereby there is provided an interface between said silicone varnish material and the rotor segment material that is located in close proximity to said output tip surface, said coating being effective to reduce the breakdown potential across said distributor arc gap whereby the radiation of the radio frequency interference generated by an electrical discharge across said distributor arc gap is suppressed; and at least one opening in a portion of said silicone varnish material coating that is in engagement with said spring contact member for providing an electrical arcing conductive path between said rotor segment and spring contact member, said opening being formed by applying an electrical potential across said portion of said coating of a level sufficient to rupture said coating.

* * * * *